US010753668B2

(12) United States Patent
Xu et al.

(10) Patent No.: US 10,753,668 B2
(45) Date of Patent: Aug. 25, 2020

(54) REVERSE CYCLE DEFROST REFRIGERATION SYSTEM AND METHOD

(71) Applicant: KEEPRITE REFRIGERATION, INC., Longview, TX (US)

(72) Inventors: Yonghui Xu, Flower Mound, TX (US); David Lee Selby, Tyler, TX (US)

(73) Assignee: KEEPRITE REFRIGERATION, INC., Longview, TX (US)

( * ) Notice: Subject to any disclaimer, the term of this patent is extended or adjusted under 35 U.S.C. 154(b) by 157 days.

(21) Appl. No.: 15/899,764

(22) Filed: Feb. 20, 2018

(65) Prior Publication Data

US 2018/0238602 A1 Aug. 23, 2018

Related U.S. Application Data

(60) Provisional application No. 62/460,451, filed on Feb. 17, 2017.

(51) Int. Cl.
*F25D 21/00* (2006.01)
*F25B 13/00* (2006.01)
(Continued)

(52) U.S. Cl.
CPC ..... *F25D 21/004* (2013.01); *F25B 13/00* (2013.01); *F25B 47/025* (2013.01); *F25B 49/027* (2013.01); *F25D 21/008* (2013.01); *F25D 21/14* (2013.01); *F25B 2313/0294* (2013.01); *F25B 2313/02741* (2013.01); *F25B 2313/0312* (2013.01); *F25B 2313/0313* (2013.01); *F25B 2313/0314* (2013.01); *F25B 2400/0411* (2013.01); *F25B 2600/01* (2013.01); *F25D 2700/121* (2013.01)

(58) Field of Classification Search
CPC ..... F25B 47/025; F25B 39/028; F25B 49/02; F25B 2700/21161; F25B 2700/197; F25B 2313/02741; F25B 2313/0294; F25B 2321/411; F25B 2700/11; F25B 2700/172; F25D 21/06; F25D 21/004; F25D 21/008; F25D 21/14; F25D 2321/1411
See application file for complete search history.

(56) References Cited

U.S. PATENT DOCUMENTS 3,664,150 A 5/1972 Patterson
3,677,025 A 7/1972 Payne
(Continued)

*Primary Examiner* — Elizabeth J Martin
(74) *Attorney, Agent, or Firm* — Sheridan Ross P.C.

(57) ABSTRACT

A method of defrosting an indoor coil in a refrigeration system including, while the system is operating in the refrigeration mode, with a controller of the refrigeration system, determining a defrost commencement time at which the refrigeration system is to commence operating in the defrost mode. With the controller, one or more defrost energy conservation processes are initiated prior to the defrost commencement time, to decrease a rate at which thermal energy is transferred from the refrigerant in the outdoor coil to ambient air around the outdoor coil. The defrost energy conservation process continues until a defrost energy conservation termination criterion is satisfied, at which time the defrost energy conservation process is terminated. Upon termination of the defrost energy conservation process, operation of the refrigeration system in the defrost mode is commenced.

12 Claims, 4 Drawing Sheets

(51) Int. Cl.

| | |
|---|---|
| ***F25B 47/02*** | (2006.01) |
| ***F25B 49/02*** | (2006.01) |
| ***F25D 21/14*** | (2006.01) |

(56) References Cited

U.S. PATENT DOCUMENTS

| | | | | |
|---|---|---|---|---|
| 4,193,781 | A | 3/1980 | Vogel et al. | |
| 4,389,851 | A | 6/1983 | Chrostowski et al. | |
| 4,995,241 | A | 2/1991 | Vandervaart | |
| 5,315,836 | A | 5/1994 | Ressler | |
| 5,507,154 | A | 4/1996 | Grant | |
| 5,845,502 | A | 12/1998 | Chen et al. | |
| 6,745,583 | B2 | 6/2004 | So et al. | |
| 8,479,527 | B2 | 7/2013 | Song et al. | |
| 8,567,203 | B2 | 10/2013 | Jang et al. | |
| 2013/0180269 | A1 | 5/2013 | Nagata et al. | |
| 2013/0312437 | A1 | 11/2013 | Davies et al. | |
| 2015/0159935 | A1 | 6/2015 | Wei et al. | |
| 2015/0184926 | A1 | 7/2015 | Yun | |
| 2016/0223236 | A1* | 8/2016 | Kimura | F24F 3/065 |

* cited by examiner

REVERSE CYCLE DEFROST REFRIGERATION SYSTEM AND METHOD

This application claims priority to U.S. Provisional Patent Application No. 62/460,451, filed on Feb. 17, 2017, which is hereby incorporated herein by reference in its entirety.

FIELD OF THE INVENTION

The present invention is a reverse cycle defrost refrigeration system, and a method of conserving defrost energy for its utilization during operation of the refrigeration system in defrost mode.

BACKGROUND OF THE INVENTION

As is well known in the art, the indoor coil in a vapor compression refrigeration system typically is required to be defrosted from time to time. Various devices and methods in this regard are known. The more commonly known defrosting methods, i.e., electric defrost and the off-cycle defrost, have certain disadvantages.

Reverse cycle defrost is a less commonly used defrost method, partially due to the limited ambient temperature range in which acceptable defrost performance is feasible. In certain conditions, there may be insufficient thermal energy in the refrigeration system for effective defrost of an indoor coil during operation in defrost mode. For instance, in the prior art, in situations where an outdoor coil of a refrigeration system is subjected to ambient conditions, significant changes in the ambient conditions may have an impact on the defrost performance of the refrigeration system. In particular, low-temperature ambient conditions may cause a number of problems in the operation of the refrigeration system. For example, when using known reverse cycle defrost methods in low-temperature ambient conditions, a relatively long time is required for defrosting. However, in practice, the length of time in which the system may be in defrost mode is limited.

SUMMARY OF THE INVENTION

For the foregoing reasons, there is a need for a reversible vapor compression refrigeration system that overcomes or mitigates one or more of the disadvantages or defects of the prior art. Such disadvantages or defects are not necessarily included in those described above.

In its broad aspect, the invention provides a method of defrosting an indoor coil in a refrigeration system in which a refrigerant is circulatable in a first direction, to transfer heat out of a volume of air in a controlled space when the refrigeration system is operating in a refrigeration mode, and in which the refrigerant is circulatable in a second direction at least partially opposite to the first direction when the refrigeration system is operating in a defrost mode. The refrigeration system includes an outdoor coil at least partially immersed in ambient air at a number of ambient temperatures to facilitate transferring thermal energy from the refrigerant in the outdoor coil to the ambient air. The method includes, while the system is operating in the refrigeration mode, and with a controller of the refrigeration system, determining a defrost commencement time at which the refrigeration system is to commence operating in the defrost mode. With the controller, one or more defrost energy conservation processes are initiated prior to the defrost commencement time, to decrease a rate at which thermal energy is transferred from the refrigerant in the outdoor coil to the ambient air. The defrost energy conservation process is permitted to continue until a defrost energy conservation termination criterion is satisfied. Upon the defrost energy conservation termination criterion being satisfied, the defrost energy conservation process is terminated. Upon termination of the defrost energy conservation process, operation of the refrigeration system in the defrost mode is commenced, by energizing a reversing valve to direct the refrigerant to flow in the second direction into the indoor coil, to defrost the indoor coil.

In another of its aspects, the invention provides a refrigeration system in which a refrigerant is circulatable in a first direction, to transfer heat out of a volume of air in a controlled space when the refrigeration system is operating in a refrigeration mode, and in which the refrigerant is circulatable in a second direction at least partially opposite to the first direction when the refrigeration system is operating in a defrost mode. The refrigeration system includes an outdoor coil at least partially immersed in ambient air at a number of ambient temperatures to facilitate transferring thermal energy from the refrigerant in the outdoor coil to the ambient air. The refrigeration system includes a controller configured for determining, while the system is operating in the refrigeration mode, a defrost commencement time at which the refrigeration system is to commence operating in the defrost mode. The controller is also configured to initiate one or more defrost energy conservation processes prior to the defrost commencement time, to decrease a rate at which thermal energy is transferred from the refrigerant in the outdoor coil to the ambient air. The controller additionally is configured to permit the defrost energy conservation process to continue until a defrost energy conservation termination criterion is satisfied. The controller is also configured, upon the defrost energy conservation termination criterion being satisfied, to terminate the defrost energy conservation process. In addition, the controller is configured, upon termination of the defrost energy conservation process, to commence operation of the refrigeration system in the defrost mode by energizing a reversing valve to direct the refrigerant to flow in the second direction into the indoor coil, to defrost the indoor coil.

BRIEF DESCRIPTION OF THE DRAWINGS

The invention will be better understood with reference to the attached drawings, in which.

DETAILED DESCRIPTION

Figure 1A:
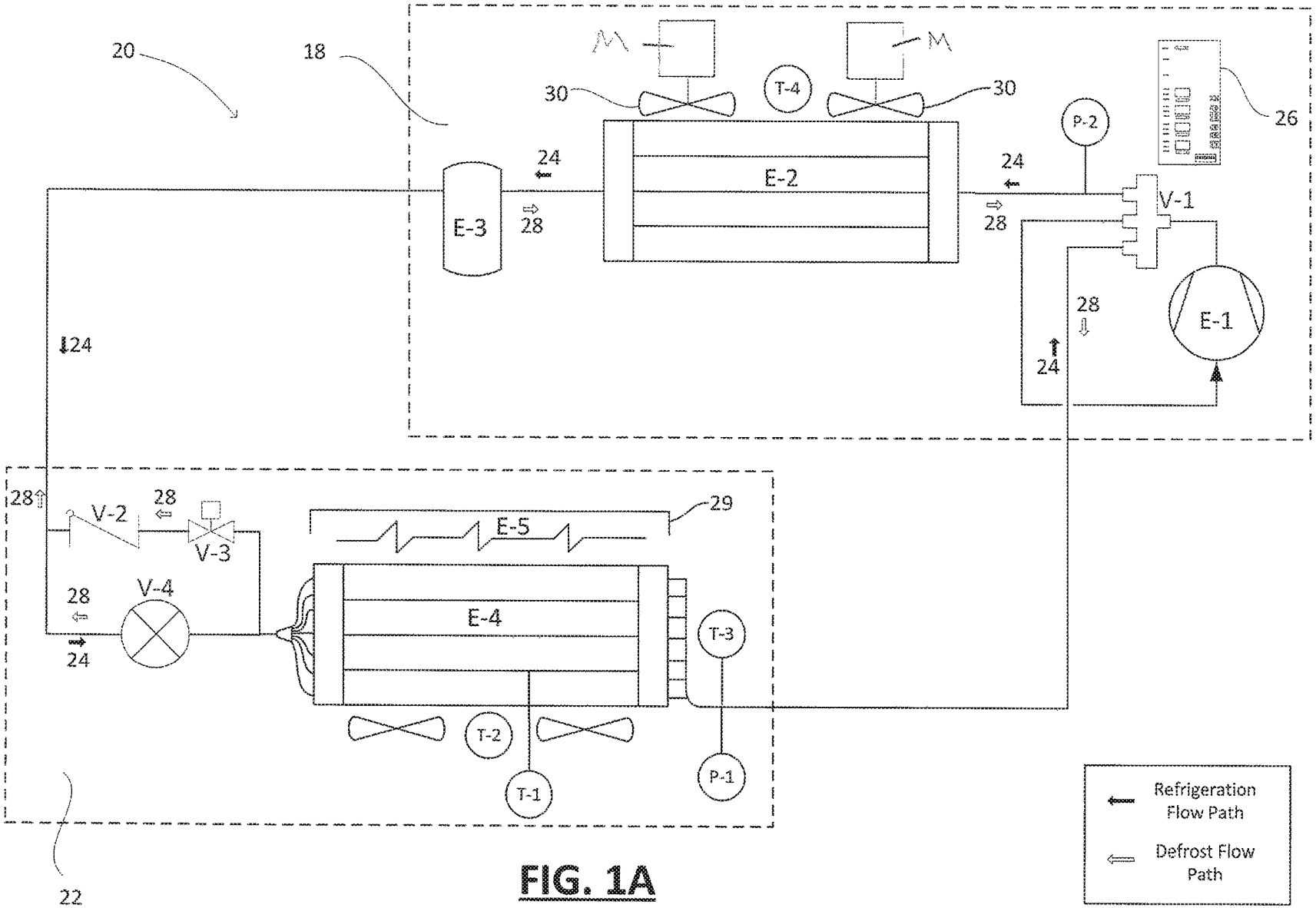
FIG. 1A is a schematic diagram of an embodiment of a refrigeration system of the invention.

In the attached drawings, like reference numerals designate corresponding elements throughout. Reference is first made to FIG. 1A to describe an embodiment of a refrigeration system of the invention indicated generally by the numeral 20 that is schematically illustrated therein.

Preferably, the refrigeration system 20 is operable both in a refrigeration mode, and alternately, in a defrost mode. The refrigeration system 20 preferably includes an indoor coil E-4 which removes heat from a controlled space (not shown), when the refrigeration system 20 operates in the refrigeration mode.

The operation of the refrigeration system 20 in the refrigeration mode, which is generally conventional (except as hereinafter described), will now be described. It is preferred that the refrigeration system 20 includes an outdoor coil E-2 that is located outside, i.e., at least partially exposed to ambient atmosphere or ambient air 18, and consequently is subject to ambient temperatures. The outdoor coil is at least partially immersed in the ambient air 18, which may be at a number of ambient air temperatures over time, to facilitate transferring thermal energy from the refrigerant in the outdoor coil to the ambient air 18.

In the refrigeration system 20, a refrigerant (not shown) preferably is circulated in a first direction, when the refrigeration system 20 is operating in the cooling or refrigeration mode. In FIG. 1A, arrows 24 indicate the direction of travel of the refrigerant when the refrigeration system 20 is operating in the refrigeration mode. A compressor E-1 of the refrigeration system 20 preferably pressurizes the refrigerant, which typically is drawn into the compressor E-1 in the form of a vapor, and moves the hot refrigerant vapor through the outdoor coil E-2, where the heat of compression is released to the ambient air causing the refrigerant moving through the outdoor coil E-2 to condense. While the refrigeration system 20 is in the refrigeration mode, the refrigerant is also moved from the outdoor coil E-2 through a receiver E-3, which it exits in generally liquid form. The liquid refrigerant then moves past a liquid line solenoid V-6 to an expansion valve V-8. When the refrigerant moves through the expansion valve V-8, it is expanded into a low pressure two-phase mixture. The refrigerant then moves to the indoor coil E-4, where the refrigerant removes heat from the controlled space, primarily due to the latent heat of vaporization. The refrigerant is returned to the compressor E-1 as a low pressure superheated vapor to complete the cycle.

In one embodiment, the refrigeration system 20 additionally includes sensors, identified for convenience in FIG. 1A as P-1, P-2, T-1, T-2, T-3, and T-4. The sensors P-1 and P-2 sense pressure exerted by the refrigerant at the locations respectively indicated in FIG. 1A, and the sensor T-1 detects the temperature of the refrigerant in the interior coil. The sensor T-2 detects the temperature of the air in the controlled space. As will be described, the sensor T-3 detects the temperature of the refrigerant inside the tubing of the refrigeration system at the location indicated in FIG. 1A. The sensor T-4 detects the temperature of the ambient air (the ambient temperature). Those skilled in the art would be aware of suitable sensors.

The refrigeration system 20 preferably also includes a controller 26 which controls the operation of the refrigeration system 20, based at least on conditions as sensed by the sensors. The controller 26 may be, for example, a suitable microcontroller, which may be preprogrammed. Those skilled in the art would be aware of a suitable controller. It will be understood that the controller 26 is connected to and in communication with a number of elements of the system 20, and that such connections are generally omitted from FIG. 1A for clarity of illustration.

As is well known in the art, when the refrigerant moving through the indoor coil E-4 removes heat from the controlled space 22, it also removes moisture therefrom, which condenses on the exterior of the indoor coil E-4. The moisture, in the form of frost, may accumulate until the indoor coil E-4 cannot work properly. At that point, it is necessary for the refrigeration system 20 to operate in defrost mode. The requirement to defrost is determined by the controller 26 in accordance with conventional techniques that would be known to those skilled in the art.

When the refrigeration system 20 is in its defrost mode, the refrigerant circulates in the direction identified by arrows 28 in FIG. 1A.

In one embodiment, the invention preferably includes a method of defrosting the refrigeration system 20. As noted above, the refrigerant is circulatable in the first direction to the indoor coil E-4 to transfer heat out of a volume of air in the controlled space 22 when the refrigeration system 20 is operating in the refrigeration mode, and the refrigerant is circulatable in a second direction at least partially opposite to the first direction, when the refrigeration system 20 is operating in the defrost mode.

As noted above, due to certain conditions (e.g., low ambient temperature), the refrigerant in the refrigeration system may have insufficient thermal energy for effective defrost of the indoor coil during the defrost mode. The invention herein addresses this problem. The method of the invention is particularly applicable, for example, in low-temperature ambient conditions, which tend to decrease the temperature and pressure of the refrigerant in the outdoor coil E-2 and in the receiver E-3. This means that, in the absence of the method of the invention, the refrigerant in the outdoor coil and the receiver would have relatively less thermal energy therein (i.e., for use in defrosting) at the time when the system switches from refrigeration mode to defrost mode. In one embodiment, the method of the invention involves initiating one or more defrost energy conservation processes (described further below) before the refrigeration system 20 begins operating in the defrost mode, in order to retain more thermal energy in the refrigerant that is in the outdoor coil and the receiver at that time.

For clarity, the defrost energy conservation processes are described herein as functioning separately from each other. However, those skilled in the art would appreciate that one or more of the defrost energy conservation processes may be utilized simultaneously.

While the refrigeration system 20 is operating in the refrigeration mode, upon the controller 26 determining that the refrigeration system 20 is to commence operating in defrost mode, the controller 26 initiates the one or more defrost energy conservation processes, to retain thermal energy, which causes an increase in the temperature and pressure of the refrigerant in the outdoor coil and receiver.

Proper termination or control of the defrost energy conservation process can be accomplished using parameters including but not limited to condensing pressure, condensing temperature, time, or a combination thereof.

In addition, upon termination of the defrost energy conservation process, the method also preferably includes terminating the refrigeration mode. When the refrigeration mode is terminated, operation in the defrost mode is initiated. The defrost mode is initiated by energizing a reversing valve V-1 of the system to cause the refrigerant to flow in the second direction into the indoor coil E-4, to defrost the indoor coil E-4.

As noted above, the method of the invention is intended for use in low-temperature ambient conditions. As is well known in the art, in those conditions, when the refrigeration system is operating in the refrigeration mode, the refrigerant temperature and pressure may be inadequate for defrosting. In the method of the invention, while the refrigeration system is still operating in the refrigeration mode, the defrost energy conservation process is initiated, which is intended to retain thermal energy in the refrigerant that is in the outdoor coil before the defrost mode is initiated. The defrost energy conservation process, once initiated, would tend to increase the temperature and pressure of the refrigerant in the outdoor coil.

Those skilled in the art would appreciate that the predetermined termination criterion (or criteria, as the case may be) is chosen to promote the desired defrost performance, and may be determined based on a number of factors. For example, where the refrigerant is R404A, the predetermined termination criterion may be a condensing pressure of approximately 300 psig. This termination criterion is only an example, and for other refrigerants, and in other systems, the termination criteria may be different.

Those skilled in the art would also appreciate that pressure or temperature termination criteria may never become satisfied, in extreme low temperature ambient conditions, and for this reason it may be useful to use time as an alternative termination criterion that will override the original termination criteria (e.g., pressure, or temperature) in such circumstances. For example, if the condensing pressure from the previous example was 100 psig at the beginning of the defrost energy conservation process, and was only able to rise to 150 psig over a time period of three minutes, then it becomes useful to have an alternative time termination to override the pressure termination criterion. Accordingly, in one embodiment, a time period preferably is predetermined for this purpose.

As noted above, the method of the invention preferably involves initiation of one or more defrost energy conservation processes to retain thermal energy in the refrigerant that is located in the outdoor coil and the receiver shortly before the termination of the refrigeration mode. Those skilled in the art would appreciate that various defrost energy conservation processes may be suitable. For instance, one or more of the following defrost energy conservation processes may be suitable:

(a) stopping the outdoor coil fan;
(b) outdoor coil fan cycling;
(c) outdoor coil fan stopping and/or fan cycling (for multiple fan arrangements);
(d) outdoor coil fan speed stepping or modulating control;
(e) outdoor coil air damper;
(f) outdoor coil refrigerant circuitry control.

In one embodiment, the defrost energy conservation process preferably involves de-energizing motors "M" that are operatively connected to outdoor coil fans 30 (i.e., process (a) listed above) (FIG. 1A). This has the advantage of being relatively simple to implement.

Those skilled in the art would be aware of suitable arrangements of the motors "M" and the fans 30 which are rotated by the motors "M".

As can be seen in FIG. 1A, the outdoor coil fans 30 preferably are positioned for cooling the outdoor coil E-2, when the motors "M" of the outdoor coil fans 30 are energized. In general, cooling the outdoor coil E-2 during the refrigeration mode assists in transferring thermal energy from the refrigerant in the outdoor coil E-2 to the ambient atmosphere 18, thereby promoting condensation of the refrigerant in the outdoor coil E-2, and improving the efficiency of the refrigeration system 20, when it is operating in the refrigeration mode. However, in one embodiment of the invention herein, the motors "M" of the outdoor coil fans 30 are de-energized while the system 20 is still in refrigeration mode, commencing upon the initiation of the defrost energy conservation process. Because de-energizing the motors "M" of the outdoor coil fans 30 during the predetermined time period decreases the rate at which thermal energy is transferred from the refrigerant in the outdoor coil to the atmosphere, it is an example of a defrost energy conservation process. Those skilled in the art would appreciate that, as described above, the refrigeration system 20 preferably is still operating in the refrigeration mode while the motors "M" connected to the outdoor coil fans are de-energized.

As is well known in the art, when the system is in the defrost mode, the condensate that has frozen on an exterior surface of the indoor coil E-4 melts, and the melted condensate is collected in the drain pan 29. The drain pan 29 is designed to permit the liquid, melted condensate collected therein to drain therefrom, e.g., to an appropriate drain or receptacle. Where the controlled space is an interior space of a freezer, during the refrigeration mode, the temperature of the air in the controlled space is generally below 32° F., and (in the absence of pre-heating) the temperature of the surface of the drain pan 29 is also below 32° F. Accordingly, if the drain pan 29 is not pre-heated, then the condensate that liquefies and drips off the indoor coil E-4 onto the drain pan 29 during the defrost mode will re-freeze, on the drain pan 29. Those skilled in the art would appreciate that the accumulation of ice on the drain pan 29 can lead to problems, e.g., condensate subsequently dripping off the indoor coil during the defrost mode may flow onto the floor or elsewhere in the controlled space, if it is not collected in the drain pan 29. Those skilled in the art would also appreciate that, once ice has formed on the drain pan 29, it is very difficult to eliminate, unless very high electrical power is applied, or the ice is manually removed.

Accordingly, it is preferred that the drain pan 29 is pre-heated while the refrigeration system is still in the refrigeration mode, i.e., the pre-heating preferably commences at the initiation of the defrost energy conservation process. In this way, condensate dripping on the drain pan will not be frozen to the drain pan. Those skilled in the art would appreciate that the drain pan 29 may have an electric heating element (not shown) built into it, so that the drain pan can be heated by allowing electric current to flow through the electric heater, or may have a hot vapor drain pan loop (not shown), so that the drain pan can be heated by allowing hot discharge refrigerant vapor to flow through tubing in contact with the drain pan.

When drain pan pre-heat and defrost energy conservation occur simultaneously, it may be necessary to maintain the heat transfer rate around the termination criteria set point, after it has increased to its termination criteria, for a time period sufficient to allow the drain pan preheat process to terminate. In this case the termination criteria preferably is used as a set point and the chosen heat transfer rate preferably is modulated to maintain the pressure within a predetermined range around the termination criteria. For example, if the chosen defrost energy conservation process is outdoor coil fan cycling, the termination criteria is a condensing pressure of 300 psig, the predetermined range is 50 psig, and the termination criteria is reached before the drain pan pre-heat process is terminated, then once the termination pressure of 300 psig is achieved the motors "M" of the outdoor coil fans will be energized, in turn causing the condensing pressure to fall. Once the condensing pressure reaches 250 psig then the motors "M" of the outdoor coil fans will be de-energized, in turn causing condensing pressure to rise. The defrost energy conservation process can be modulated in this manner, until the termination of the drain pan preheat process, to achieve the desired defrost performance upon initiation of defrost mode.

In practice, it has been found that, in low-temperature ambient conditions, a longer time is required to satisfactorily heat the drain pan 29 than is required to increase the pressure to the predetermined range of pressures, when conventional components (e.g., the heating element E-5) are used. For example, it has been found that, using an electric heating element, approximately four minutes may be required to preheat the drain pan 29. However, in tests, when process (a) is utilized, the preselected upper limit pressure is reached within approximately two to three minutes in most cases.

It will be understood that the foregoing times are exemplary only. In practice, the time required to pre-heat the drain pan 29 may vary substantially from one system to another, and also may vary substantially for a particular system, depending on the conditions. Similarly, the time required to reach or exceed the termination criteria may vary substantially, depend on the system, the relevant conditions, and the defrost energy conservation process.

Figure 2:
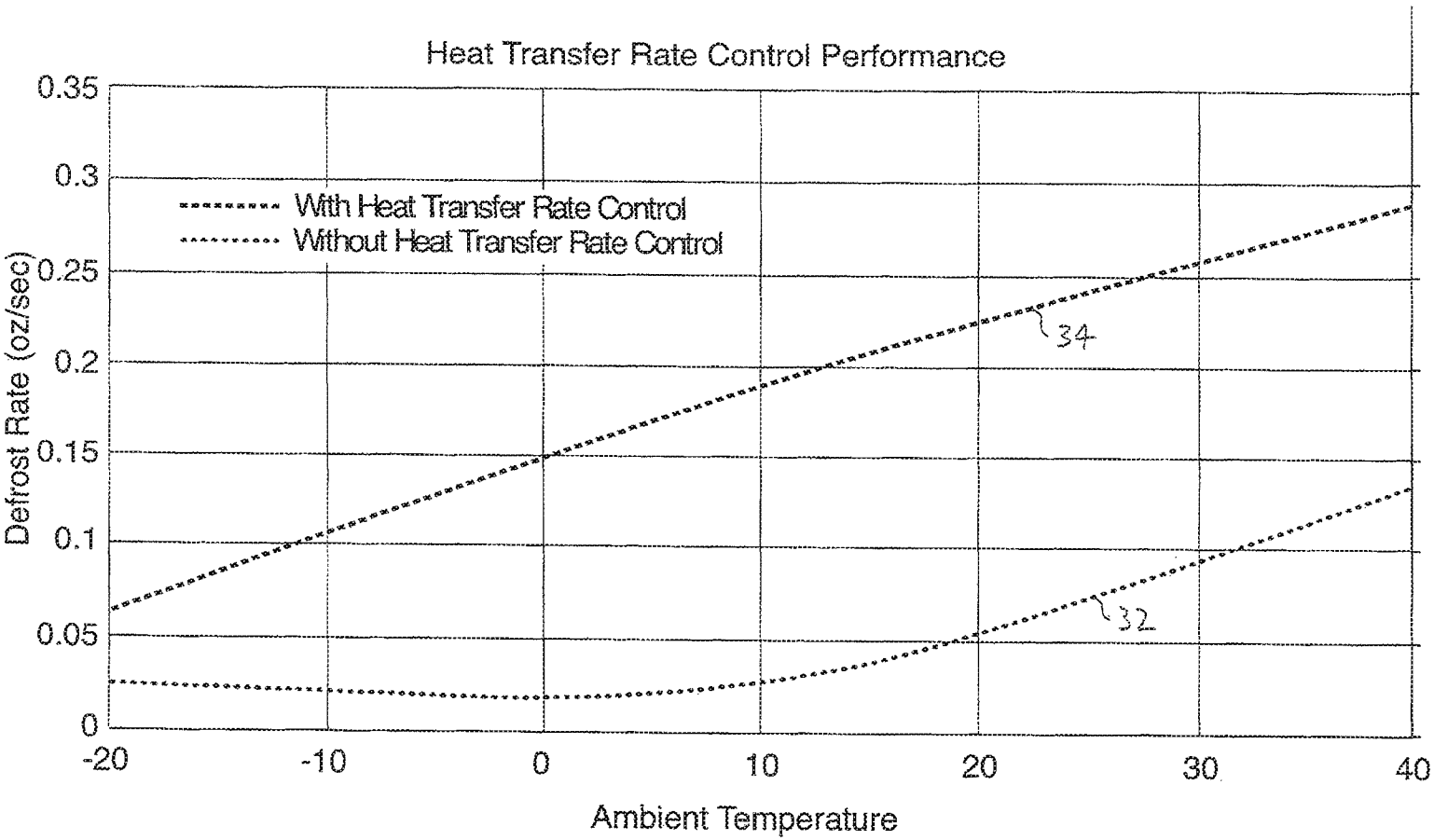
FIG. 2 is a graph in which certain data showing the operation of the refrigeration system of the invention is presented.

The method of the invention has been found to significantly improve the performance of the refrigeration system 20 in defrost mode, as illustrated in FIG. 2. In FIG. 2, the defrost rate experienced in defrost mode, without utilizing an embodiment of the invention, is identified by the reference numeral 32. (The defrost rate is the mass of frost that is melted over a certain time period.) The defrost rate of the system 20 when the invention is utilized is identified by reference numeral 34. As can be seen in FIG. 2, when the method of the invention herein is utilized, the defrost rate is significantly greater than the defrost rate experienced otherwise.

In particular, and as illustrated in FIG. 2, the method of the invention improves the performance of the system in defrost mode at all ambient temperatures over the range considered.

The data presented in FIG. 2 is from tests in which the defrost energy conservation process that was employed was that described above, i.e., de-energizing the motors of the outdoor coil fans during the refrigeration mode. It is believed that other defrost energy conservation processes (whether implemented independently, or otherwise), such as those listed above in addition to process (a), would have similar beneficial effects on the efficiency of the system in the defrost mode.

Figure 1B:
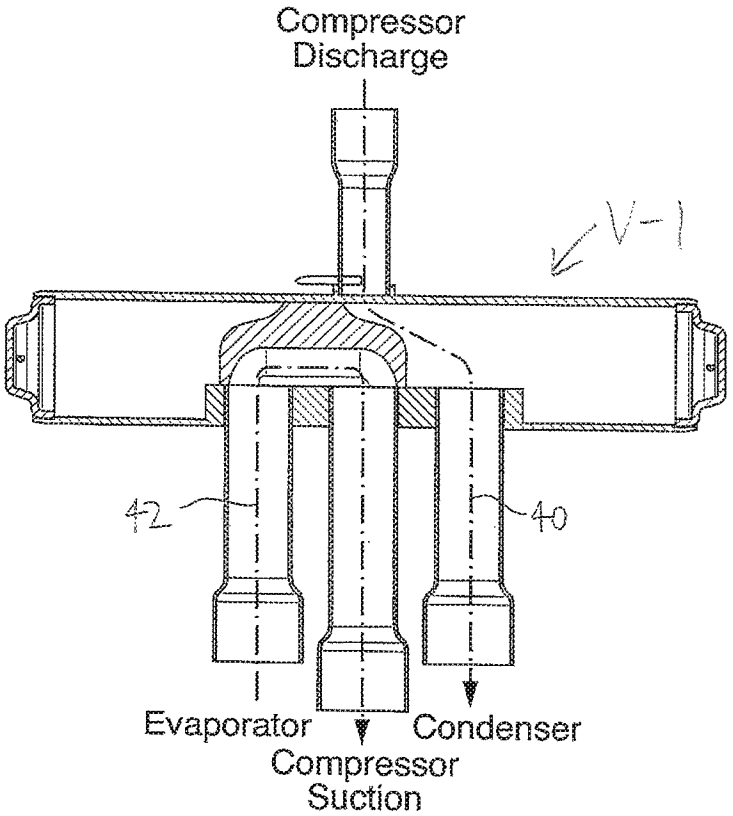
FIG. 1B is a cross-section of a four-way valve of the refrigeration system of FIG. 1A showing paths taken by refrigerant therethrough when the refrigeration system is in refrigeration mode, drawn at a larger scale.
Figure 1C:
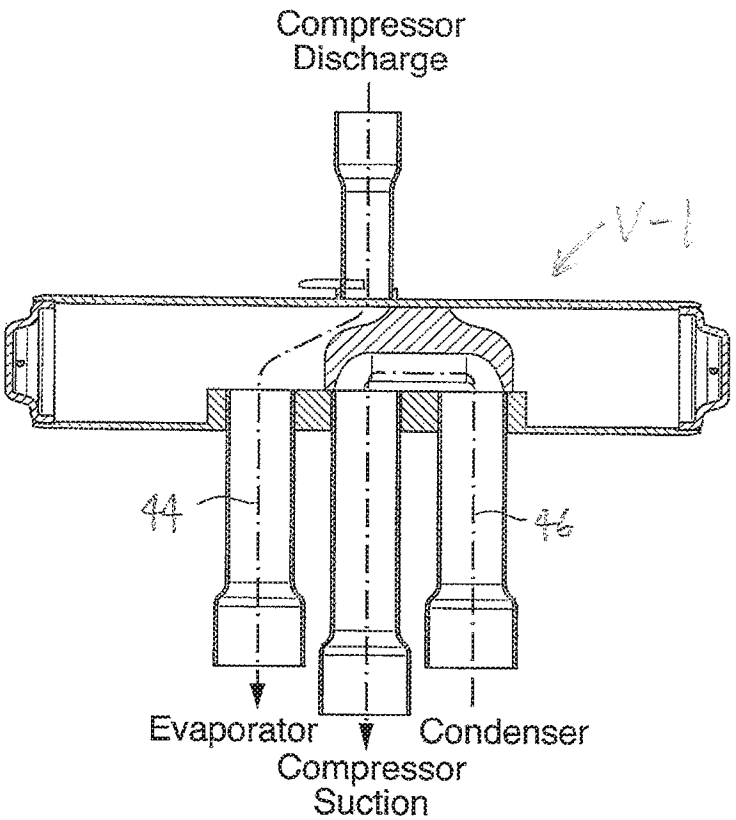
FIG. 1C is another cross-section of the four-way valve of FIG. 1B, showing paths taken by the refrigerant therethrough when the refrigeration system is in defrost mode.

The operation of the reversing valve V-1 is illustrated in FIGS. 1B and 1C. The flow of the refrigerant through the reversing valve when the refrigeration system is operating in the refrigeration mode is illustrated in FIG. 1B. In FIG. 1B, the refrigerant from the compressor E-1 flows through the valve V-1 to the outdoor coil E-2 (arrow 40). The refrigerant exiting the indoor coil E-4 is directed to the intake of the compressor E-1 (arrow 42).

Similarly, the manner in which the valve V-1 functions when the refrigeration system 20 is in the defrost mode can be seen in FIG. 1C. In this mode, the refrigerant from the compressor discharge is directed to the indoor coil E-4 (arrow 44). The refrigerant exiting the outdoor coil E-2 is directed into the compressor E-1 (arrow 46).

Accordingly, an embodiment of the invention includes a method of defrosting the indoor coil in the refrigeration system, including, while the system is operating in the refrigeration mode, with a controller of the refrigeration system, determining a defrost commencement time at which the refrigeration system is to commence operating in the defrost mode. With the controller, one or more defrost energy conservation processes are initiated prior to the defrost commencement time, to decrease a rate at which thermal energy is transferred from the refrigerant in the outdoor coil to the ambient air. The one or more defrost energy conservation processes are permitted to continue until a defrost energy conservation termination criterion is satisfied. Upon said at least one defrost energy conservation termination criterion being satisfied, the one or more defrost energy conservation processes are terminated. Upon termination of the one or more defrost energy conservation processes, operation of the refrigeration system in the defrost mode is commenced by energizing the reversing valve V-1 to direct the refrigerant to flow in the second direction into the indoor coil E-4, to defrost the indoor coil E-4.

In one embodiment, defrost energy conservation process preferably includes de-energizing the fan motors "M" that are operatively connected to the outdoor coil fans 30 positioned to direct the ambient air through the outdoor coil, wherein the rate of thermal energy transfer from the refrigerant in the outdoor coil to the ambient air is decreased. Those skilled in the art would appreciate that this would decrease the rate of heat transfer from the refrigerant to the ambient air 18 during the refrigeration mode, thereby increasing the thermal energy in the refrigerant, which will be available when operation in the defrost mode commences.

In another embodiment, defrost energy conservation process preferably alternately includes (i) de-energizing the fan motor "M" operatively connected to the fan 30 positioned to direct the ambient air through the outdoor coil E-2, and (ii) energizing the fan motor "M", to decrease the rate of thermal energy transfer from the refrigerant in the outdoor coil to the ambient air 18. Those skilled in the art would appreciate that this would also decrease the rate of heat transfer from the refrigerant to the ambient air 18 during the refrigeration mode, thereby increasing the thermal energy in the refrigerant, which will be available when operation in the defrost mode commences.

In yet another embodiment, defrost energy conservation process preferably includes modulating a speed of rotation of the fan 30 positioned to direct the ambient air through the outdoor coil, to decrease the rate of thermal energy transfer from the refrigerant in the outdoor coil to the ambient air. Those skilled in the art would be aware of suitable techniques to be used in modulating the speed of a fan's rotation. Those skilled in the art would appreciate that this would also decrease the rate of heat transfer from the refrigerant to the ambient air 18 during the refrigeration mode, thereby increasing the thermal energy in the refrigerant, which will be available when operation in the defrost mode commences.

Figure 3:
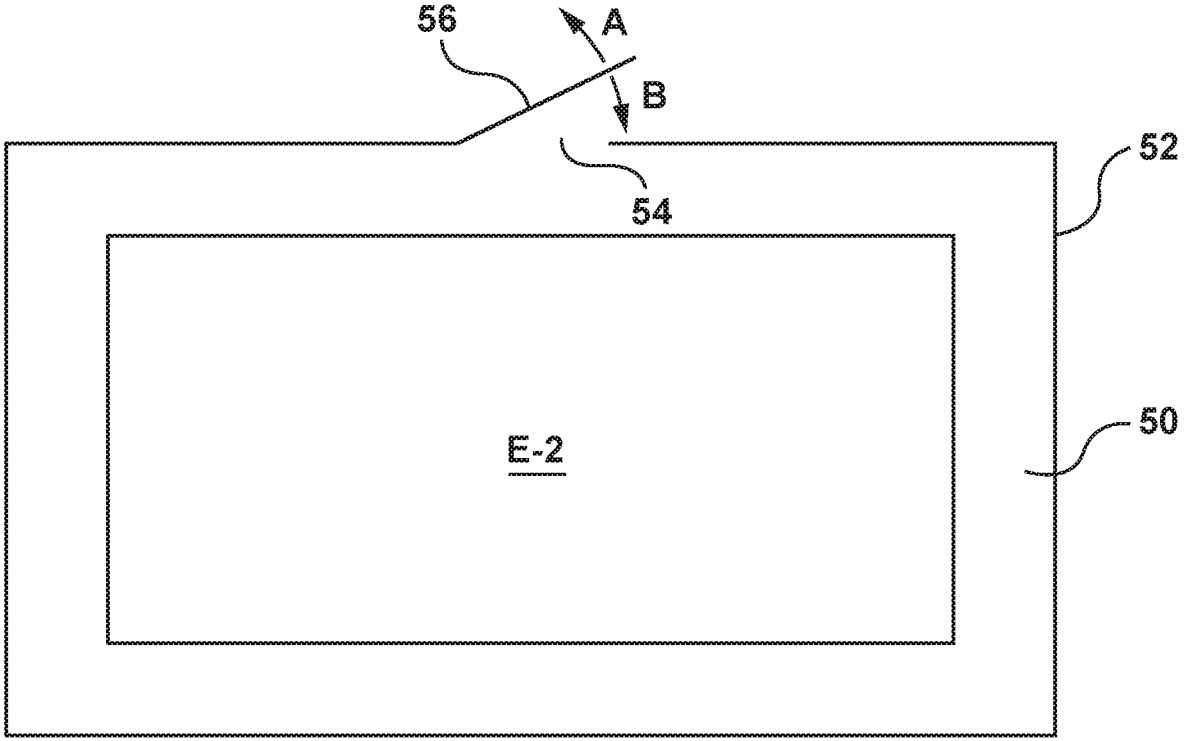
FIG. 3 is a schematic diagram of another embodiment of a portion of the refrigeration system of the invention.

As schematically illustrated in FIG. 3, in one embodiment, the outdoor coil E-2 preferably is positioned in a partially enclosed space 50 in an outdoor coil housing 52. The ambient air 18 is in fluid communication with the partially enclosed space 50 via an opening 54 in the outdoor coil housing 52. The opening 54 has a size that is variable by a damper 56 that is positionable to cover at least part of the opening 54. The defrost energy conservation process preferably includes, with the damper 56, decreasing the size of the opening 54, to decrease the rate of thermal energy transfer from the refrigerant in the outdoor coil E-2 to the ambient air 18. Those skilled in the art would be aware of suitable means and techniques for adjusting the position of the damper, to adjust the size of the opening as required to take changing ambient conditions or other conditions into account. Those skilled in the art would appreciate that decreasing the size of the opening 54 would also decrease the rate of heat transfer from the refrigerant to the ambient air 18 during the refrigeration mode, thereby increasing the thermal energy in the refrigerant, which will be available when operation in the defrost mode commences.

As illustrated in FIG. 3, the damper 56 is schematically represented in a partially opened position. The damper 56 is indicated as being movable towards more opened or more closed by arrows "A" and "B" respectively. Those skilled in the art would appreciate that the damper may be provided in a number of forms, and its positioning relative to the opening may be controlled in various ways.

Those skilled in the art would also be aware of suitable means for adjusting the flow of the refrigerant through the outdoor coil E-2. In another alternative embodiment, defrost energy conservation process preferably includes limiting the refrigerant flowing into the outdoor coil by an extent determined to decrease the rate of thermal energy transfer from the refrigerant in the outdoor coil to the ambient air. Those skilled in the art would appreciate that this would also decrease the rate of heat transfer from the refrigerant to the ambient air 18 during the refrigeration mode, thereby increasing the thermal energy in the refrigerant, which will be available when operation in the defrost mode commences.

It has been found that, when the defrost energy conservation process of the invention is used, the condensate frozen on the exterior of the indoor coil (i.e., during operation in the refrigeration mode) tends to melt relatively rapidly during operation in the defrost mode. However, as noted above, during operation in the refrigeration mode, the drain pan 29 is at a relatively low temperature, e.g., approximately −10° F., due to its location in the controlled space 22. Accordingly, upon the defrost mode commencing, the drain pan in the conventional refrigeration system is at a relatively low temperature. A consequence of this is the re-freezing of melted condensate that drips onto the drip pan 29, especially shortly after the commencement of operation in the defrost mode. Those skilled in the art would appreciate that the re-freezing of the melted condensate tends to exacerbate the problem, as the re-frozen melted condensate tends to impede the heating of the drain pan by conventional means during the defrost mode. Ultimately, the re-frozen melted condensate can accumulate in the drain pan to the extent that the drain pan is filled with it, and melted condensate may then be forced to drip onto a floor of the controlled space.

In order to address this problem, in one embodiment, the method of the invention preferably includes pre-heating the drain pan 29. As noted above, the drain pan 29 is positioned for collection of the melted condensate that has melted off the indoor coil, prior to the refrigeration system commencing operation in the defrost mode. The pre-heating of the drain pan 29 is intended to impede the melted condensate from refreezing in the drain pan.

It will be understood that pre-heating the drain pan 29 may commence at any point while the refrigeration system is operating in the refrigeration mode. However, the pre-heating preferably commences only a relatively short time prior to the refrigeration system commencing operating in the defrost mode. In one embodiment, pre-heating the drain pan 29 commences upon commencement of the one or more defrost energy conservation processes.

Similarly, pre-heating the drain pan 29 may terminate at any suitable time. Preferably, the termination of said at least one defrost energy control process is delayed until the drain pan is heated sufficiently to impede refreezing of the melted condensate on the drain pan, i.e., upon commencement of operation in the defrost mode. In one embodiment, pre-heating the drain pan 29 preferably is terminated upon termination of the one or more defrost energy conservation processes.

Those skilled in the art would appreciate that the defrost energy conservation method may be terminated upon the occurrence of any suitable condition, or conditions, characterized by the one or more termination criteria. For instance, in one embodiment, the defrost energy conservation termination criterion preferably is a predetermined discharge pressure of the refrigerant. In another embodiment, the defrost energy conservation termination criterion preferably is a predetermined time period.

In one embodiment, the refrigeration system of the invention preferably includes a controller configured for determining, while the refrigeration system is operating in the refrigeration mode, the defrost commencement time, at which time the refrigeration system is to commence operating in the defrost mode. Preferably, the controller is additionally configured to initiate one or more defrost energy conservation processes prior to the defrost commencement time, to decrease a rate at which thermal energy is transferred from the refrigerant in the outdoor coil to the ambient air. In addition, the controller preferably is configured to permit the defrost energy conservation process to continue until a defrost energy conservation termination criterion is satisfied. Preferably, the controller is also configured, upon the defrost energy conservation termination criterion being satisfied, to terminate the defrost energy conservation process. In addition, the controller preferably is configured, upon termination of the defrost energy conservation process, to commence operation of the refrigeration system in the defrost mode by energizing a reversing valve to direct the refrigerant to flow in the second direction into the indoor coil, to defrost the indoor coil.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A method of defrosting an indoor coil in a refrigeration system in which a refrigerant is circulatable in a first direction, to transfer heat out of a volume of air in a controlled space when the refrigeration system is operating in a refrigeration mode, and in which the refrigerant is circulatable in a second direction at least partially opposite to the first direction when the refrigeration system is operating in a defrost mode, the refrigeration system comprising an outdoor coil at least partially immersed in ambient air at a plurality of ambient temperatures to facilitate transferring thermal energy from the refrigerant in the outdoor coil to the ambient air, the method comprising:

(a) while the system is operating in the refrigeration mode, with a controller of the refrigeration system, determining a defrost commencement time at which the refrigeration system is to commence operating in the defrost mode;

(b) with the controller, initiating at least one defrost energy conservation process prior to the defrost commencement time, to decrease a rate at which thermal energy is transferred from the refrigerant in the outdoor coil to the ambient air;

(c) permitting said at least one defrost energy conservation process to continue until at least one defrost energy conservation termination criterion is satisfied;

(d) upon said at least one defrost energy conservation termination criterion being satisfied, terminating said at least one defrost energy conservation process; and (e) upon termination of said at least one defrost energy conservation process, commencing operation of the refrigeration system in the defrost mode by energizing a reversing valve to direct the refrigerant to flow in the second direction into the indoor coil, to defrost the indoor coil.

2. The method according to claim 1 in which said at least one defrost energy conservation process comprises de-energizing a fan motor operatively connected to a fan positioned to direct the ambient air through the outdoor coil, wherein the rate of thermal energy transfer from the refrigerant in the outdoor coil to the ambient air is decreased.

3. The method according to claim 1 in which said at least one defrost energy conservation process comprises alternately (i) de-energizing a fan motor operatively connected to a fan positioned to direct the ambient air through the outdoor coil, and (ii) energizing said fan motor, to decrease the rate of thermal energy transfer from the refrigerant in the outdoor coil to the ambient air.

4. The method according to claim 1 in which said at least one defrost energy conservation process comprises modulating a speed of rotation of a fan positioned to direct the ambient air through the outdoor coil, to decrease the rate of thermal energy transfer from the refrigerant in the outdoor coil to the ambient air.

5. The method according to claim 1 in which:

the outdoor coil is positioned in a partially enclosed space in an outdoor coil housing and the ambient air is in fluid communication with the partially enclosed space via an opening in the outdoor coil housing, the opening having a size that is variable by a damper that is positionable to cover at least part of the opening; and said at least one defrost energy conservation process comprises, with the damper, decreasing the size of the opening, to decrease the rate of thermal energy transfer from the refrigerant in the outdoor coil to the ambient air.

6. The method according to claim 1 additionally comprising pre-heating a drain pan positioned for collection of a melted condensate that has melted off the indoor coil, prior to the refrigeration system commencing operation in the defrost mode, in order to impede the melted condensate from refreezing in the drain pan.

7. The method according to claim 6 in which pre-heating the drain pan commences upon commencement of said at least one defrost energy conservation process.

8. The method according to claim 7 in which pre-heating the drain pan is terminated upon termination of said at least one defrost energy conservation process.

9. The method according to claim 7 in which the termination of said at least one defrost energy control process is delayed until the drain pan is heated sufficiently to impede refreezing of the melted condensate on the drain pan.

10. The method according to claim 1 in which said at least one defrost energy conservation termination criterion is a predetermined discharge pressure of the refrigerant.

11. The method according to claim 1 in which said at least one defrost energy conservation termination criterion is a predetermined time period.

12. A refrigeration system in which a refrigerant is circulatable in a first direction, to transfer heat out of a volume of air in a controlled space when the refrigeration system is operating in a refrigeration mode, and in which the refrigerant is circulatable in a second direction at least partially opposite to the first direction when the refrigeration system is operating in a defrost mode, the refrigeration system comprising an outdoor coil at least partially immersed in ambient air at a plurality of ambient temperatures to facilitate transferring thermal energy from the refrigerant in the outdoor coil to the ambient air, the refrigeration system comprising:

a controller configured for determining, while the system is operating in the refrigeration mode, a defrost commencement time at which the refrigeration system is to commence operating in the defrost mode;

the controller additionally being configured to initiate at least one defrost energy conservation process prior to the defrost commencement time, to decrease a rate at which thermal energy is transferred from the refrigerant in the outdoor coil to the ambient air;

the controller additionally being configured to permit said at least one defrost energy conservation process to continue until at least one defrost energy conservation termination criterion is satisfied;

the controller additionally being configured, upon said at least one defrost energy conservation termination criterion being satisfied, to terminate said at least one defrost energy conservation process; and the controller additionally being configured, upon termination of said at least one defrost energy conservation process, to commence operation of the refrigeration system in the defrost mode by energizing a reversing valve to direct the refrigerant to flow in the second direction into the indoor coil, to defrost the indoor coil.

* * * * *